US007076181B2

(12) United States Patent
Kellie et al.

(10) Patent No.: US 7,076,181 B2
(45) Date of Patent: Jul. 11, 2006

(54) CLOSED LOOP CONTROL OF PHOTORECEPTOR SURFACE VOLTAGE FOR ELECTROPHOTOGRAPHIC PROCESSES

(75) Inventors: Truman F. Kellie, Lakeland, MN (US); William D. Edwards, New Richmond, WI (US); Robert E. Brenner, New Richmond, WI (US)

(73) Assignee: Samsung Electronics Company, Ltd., Suwon (KR)

( * ) Notice: Subject to any disclaimer, the term of this patent is extended or adjusted under 35 U.S.C. 154(b) by 24 days.

(21) Appl. No.: 10/884,689

(22) Filed: Jun. 30, 2004

(65) Prior Publication Data

US 2006/0002728 A1 Jan. 5, 2006

(51) Int. Cl.
*G03G 15/02* (2006.01)

(52) U.S. Cl. ..... 399/50; 399/48

(58) Field of Classification Search ..... 399/48, 399/50, 51, 128

See application file for complete search history.

(56) References Cited

U.S. PATENT DOCUMENTS

| | | | | |
|---|---|---|---|---|
| 4,420,244 | A | 12/1983 | Landa | |
| 4,438,099 | A | 3/1984 | Azzariti | |
| 4,935,777 | A | 6/1990 | Noguchi et al. | |
| 4,939,542 | A | 7/1990 | Kurando et al. | |
| 4,963,926 | A | 10/1990 | Onishi et al. | |
| 5,173,434 | A | 12/1992 | Shimizu et al. | |
| 5,182,596 | A | 1/1993 | Nakazawa et al. | |
| 5,285,242 | A | 2/1994 | Kotani et al. | |
| 5,305,060 | A | 4/1994 | Fukushima | |
| 5,355,197 | A | 10/1994 | Hopkins | |
| 5,436,697 | A | 7/1995 | Negishi | |
| 5,534,977 | A | 7/1996 | Saitoh et al. | |
| 5,602,628 | A | 2/1997 | Sugiyama et al. | |
| 5,659,839 | A | 8/1997 | Mizude et al. | |
| 5,733,698 | A | 3/1998 | Lehman et al. | |
| 5,916,718 | A | 6/1999 | Kellie et al. | |
| 6,223,006 | B1 | 4/2001 | Scheuer et al. | |
| 6,365,307 | B1 | 4/2002 | Markovics | |
| 6,591,071 | B1 * | 7/2003 | Hayashi | 399/48 |

* cited by examiner

*Primary Examiner*—Hoang Ngo
(74) *Attorney, Agent, or Firm*—Kagan Binder, PLLC

(57) ABSTRACT

A method of maintaining a surface charge on a photoreceptor within a predetermined voltage range is provided, comprising the steps of providing a charging device adjacent to a surface of the photoreceptor, determining a reference voltage to be applied by the charging device to the photoreceptor surface to establish a first photoreceptor surface voltage, and applying the reference voltage to the surface of the moving photoreceptor with the charging device while measuring a first photoreceptor current. The method further comprises comparing the first photoreceptor current to predetermined characteristics of the photoreceptor to calculate a first output value, comparing the first output value to predetermined characteristics of the photoreceptor and calculating a first correction voltage, and applying the first correction voltage to the photoreceptor surface with the charging device to obtain a surface voltage on the photoreceptor that is within the predetermined operational voltage range.

25 Claims, 5 Drawing Sheets

CLOSED LOOP CONTROL OF PHOTORECEPTOR SURFACE VOLTAGE FOR ELECTROPHOTOGRAPHIC PROCESSES

TECHNICAL FIELD

The present invention relates to an image forming apparatus such as an electrophotographic photocopying machine, and more particularly relates to methods and devices for monitoring and adjusting the electrostatic condition of a photoreceptive element in an electrophotographic process.

BACKGROUND OF THE INVENTION

Electrophotography forms the technical basis for various well-known imaging processes, including photocopying and some forms of laser printing. Electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a photoreceptor, including charging, exposure, development, transfer, fusing, cleaning, and erasure.

In the charging step, a photoreceptor is covered with charge of a desired polarity, either negative or positive, typically with a charging device, such as a corona or charging roller. In the exposure step, an optical system, typically a laser scanner or light-emitting diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light" or actinic radiation, may include infrared radiation, visible light, and ultraviolet radiation, for example.

In the development step, toner particles of the appropriate polarity are generally brought into contact with the latent image on the photoreceptor, typically using an electrically-biased development roller to bring the charged toner particles into close proximity to the photoreceptive element. The polarity of the development roller should be the same as that of the toner particles and the electrostatic bias potential on the development roller should be higher than the potential of the imagewise discharged surface of the photoreceptor so that the toner particles migrate to the photoreceptor and selectively develop the latent image via electrostatic forces, forming a toned image on the photoreceptor.

In the transfer step, the toned image is transferred from the photoreceptor to the desired final image receptor. An intermediate transfer element is sometimes used to effect transfer of the toned image from the photoreceptor with subsequent transfer of the toned image to a final image receptor. The transfer of an image typically occurs by either elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic forces or charge differential phenomena between the receptor surface and the temporary carrier surface or medium for the toner. Electrostatic transfer may be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Two types of toner that are in widespread, commercial use for electrophotographic processes include liquid toners and dry toners. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles, ranging from about 5 microns to sub-micron. The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Photoreceptors generally have a photoconductive layer that transports charge (either by an electron transfer or charge transfer mechanism) when the photoconductive layer is exposed to activating electromagnetic radiation or light. The photoconductive layer is generally affixed to an electroconductive support, such as a conductive drum or an insulative substrate that is vapor coated with aluminum or another conductor. The surface of the photoreceptor can be either negatively or positively charged so that when activating electromagnetic radiation strikes certain regions of the photoconductive layer, charge is conducted through the photoreceptor to neutralize, dissipate or reduce the surface potential in those activated regions. In order to achieve certain performance characteristics of the photoreceptor, it is advantageous for the charge on the photoreceptor surface to be maintained within certain ranges, even after extended use of the photoreceptor.

An optional barrier layer may be used over the photoconductive layer to protect the photoconductive layer and thereby extend the service life of the photoconductive layer. Other layers, such as adhesive layers, priming layers, or charge injection blocking layers, are also used in some photoreceptors. These layers may either be incorporated into the photoreceptor material chemical formulation, or may be applied to the photoreceptor substrate prior to the application of the photoreceptive layer or may be applied over the top of photoreceptive layer. A permanently bonded release layer may also be used on the surface of the photoreceptor to facilitate transfer of the image from the photoreceptor to either the final substrate, such as paper, or to an intermediate transfer element, particularly when an adhesive transfer process is used. U.S. Pat. No. 5,733,698 describes an exemplary permanently bonded release layer suitable for use in imaging processes using adhesive transfer.

The photoreceptors used in electrophotographic processes, such as those described above, tend to become stressed or fatigued after numerous printing cycles due to the repetitive charging and discharging of the photoreceptive surface. This is true for printing processes that use either liquid or dry toner. One of the indicators of photoreceptor fatigue is that the value of the charge on a fatigued photoreceptor surface is lower than the charge on the surface of a new or unstressed photoreceptor when subjected to the same charging conditions from a charging device. This reduced charge on the photoreceptor surface may be caused by an inability to establish the charge-up voltage on the photoreceptor surface with a fixed excitation by the charging device (i.e., the charge acceptance of the photoreceptor surface decreases as a function of time). The reduced photoreceptor surface charge my also be caused by an inability of the photoreceptor surface to hold or maintain the charge-up voltage for a certain period of time (i.e., the dark decay of the photoreceptor surface increases with repeated use of the photoreceptor). In these cases where a photoreceptor cannot accept and/or maintain a desired surface charge as it ages, the printed images will begin to exhibit a background stain or "ghosting" effect. When this occurs, the user will typically discard the aged photoreceptor and replace it with a new photoreceptor that is capable of again accepting and maintaining a specified charge-up voltage. However, there are techniques in the art that have been used to extend the life of a photoreceptor.

One approach that may be used to extend the useful life of a photoreceptor is to increase the voltage provided by the charging device. Ideally, this voltage increase will reestablish a desired surface charge on the photoreceptor surface to thereby improve the print quality. To determine the necessary increase in the charging device voltage, historical data is often collected regarding the photoreceptor performance, which can be plotted or recorded to predict the performance of similar photoreceptors when subjected to the same conditions. The photoreceptor performance data is often measured with an electrostatic voltage probe near the photoreceptor. The voltage measurements can then be sent to a processor for calculation of any adjustments that need to be made to the charging device voltage. One drawback to this technique is that the electrostatic voltage sensor heads or devices are relatively large as compared to the small amount of space available inside a printer. In addition, electrostatic voltmeter systems are often relatively costly. In a four-channel color printing machine, four voltmeter systems are needed to monitor the surface charge on four different photoreceptors (one for each color) during printing, which further increases the space needed within a printing device and increases the system costs. It is therefore desirable to provide an improved method and system for measuring and adjusting the surface voltage of a photoreceptor. It is further desirable that such methods and systems will use accurate measurement equipment that is relatively small and inexpensive.

SUMMARY OF THE INVENTION

In one aspect of this invention, a method of maintaining a surface charge on a photoreceptor within a predetermined operational voltage range is provided, the method comprising the steps of providing a charging device adjacent to an outer surface of the photoreceptor, determining a reference voltage to be applied by the charging device to the photoreceptor outer surface to establish a first photoreceptor surface voltage that is within the predetermined operational voltage range, and applying the reference voltage to the outer surface of the moving photoreceptor with the charging device while measuring a first photoreceptor current. The method further comprises comparing the first photoreceptor current to predetermined characteristics of the photoreceptor to calculate a first output value, comparing the first output value to predetermined characteristics of the photoreceptor and calculating a first correction voltage to be applied by the charging device, and applying the first correction voltage to the photoreceptor outer surface with the charging device to obtain a surface voltage on the photoreceptor that is within the predetermined operational voltage range.

In another aspect of the invention, maintaining a surface charge on a photoreceptor involves establishing a photoreceptor current and photoreceptor surface voltage relationship for a particular type of photoreceptor being used, such as when the photoreceptor is relatively new or unused. The voltage supplied by a charging device may be varied to acquire this data. This information may be installed in the memory of a processor, such as a CPU. Further, the relationship between the photoreceptor current and surface voltage as the photoreceptor ages is acquired, where the charging device is preferably set at a "default" setting. This information may also be installed in the memory of a processor, such as a CPU. The default voltage condition may then be applied to the charging device and the photoreceptor current recorded with the printer is not printing. This may be a type of calibration procedure. This photoreceptor current may be compared to table values to determine and estimated surface charge on the photoreceptor. The charging device voltage may then be corrected using the result of the calibration procedure as compared to the tables in the processor memory to get the desired voltage.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Figure 1:
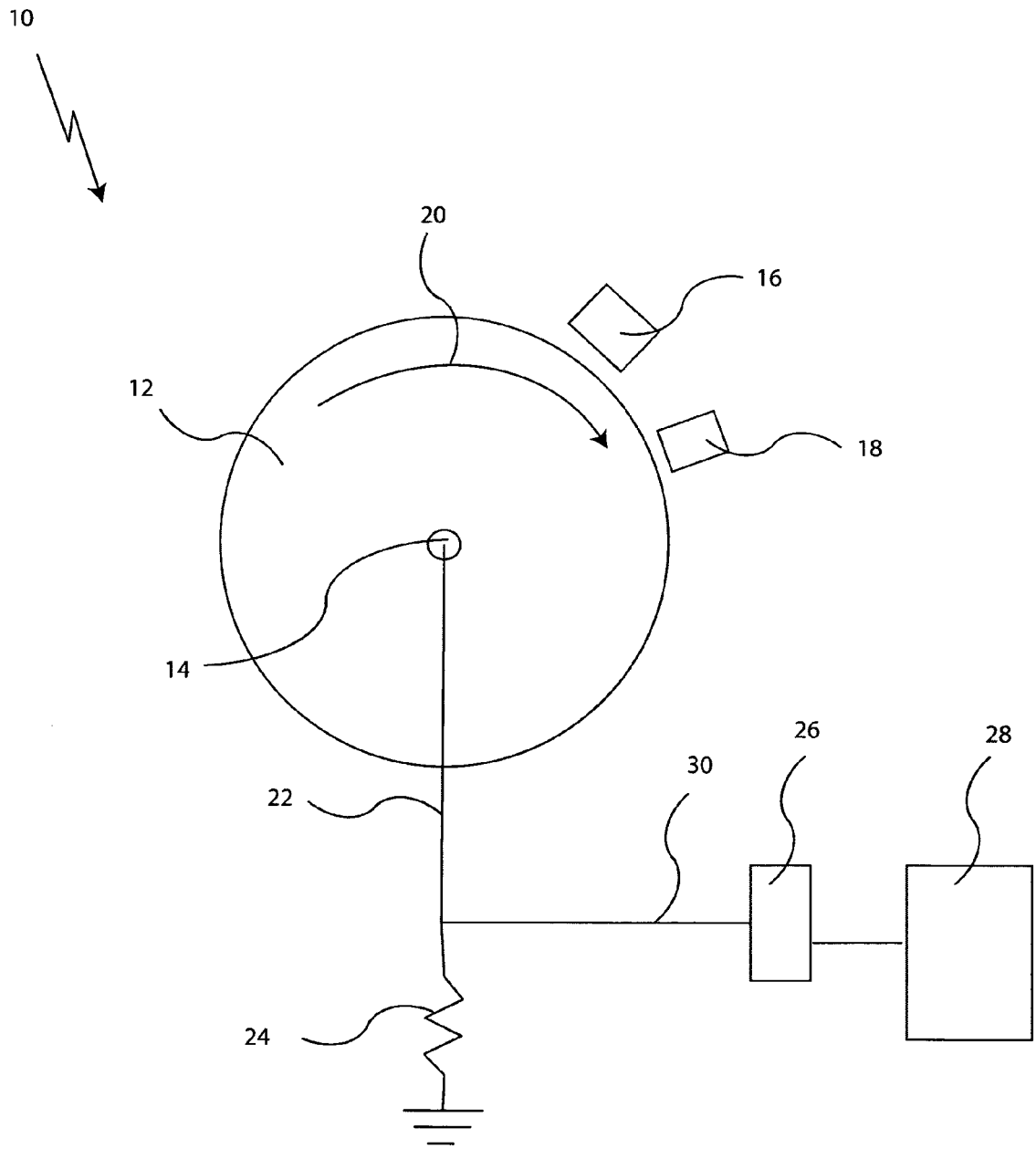
FIG. 1 is a schematic view of a portion of an electrophotographic printing device in accordance with the present invention.

Referring now to the Figures, wherein the components are labeled with like numerals throughout the several Figures, one preferred configuration of an electrophotographic apparatus or system 10 is schematically shown in FIG. 1. The system 10 generally includes a photoreceptor drum 12 having a conductive core 14, an erasure device 16, and a charging device 18. The photoreceptor drum 12 rotates at a generally constant speed in a direction shown by arrow 20 during the operation of the printer in which it is installed. The photoreceptor drum 12 is preferably cylindrical in shape and comprises a base portion that is metal, such as aluminum. A photosensitive material layer that is capable of being charged repeatedly is preferably coated onto the outside of the base cylinder portion. Although not shown in this figure, the photoreceptor drum 12 may have a number of devices positioned about its periphery in addition to the erasure device 16 and charging device 18. For example, the system 10 may additionally include some combination of the following: an exposing device, at least one development station, a transfer unit, a fusing unit, and a cleaning device. Although the photoreceptor 10 is described in this non-limiting example as a cylindrical drum, it may instead be a drum of a different shape, such as a photoreceptive element having a varying cross-section across its width, or may instead be a belt, a sheet, or some other photoreceptor configuration. In these cases, the devices used in the electrophotographic process will be arranged relative to the photoreceptive element to provide the necessary functions for producing a toned image.

The charging device 18 may be any suitable device that can provide a constant charge to the photoreceptor drum surface. For one example, the charging device 18 may be a non-contact device such as corona wire that extends generally along the width of the photoreceptor drum. Such a corona device may be further provided with a metal shield surrounding at least part of the corona wire along its length to direct the charge toward the drum, and a corona grid adjacent to and spaced from the surface of the photoreceptor drum that serves to uniformly distribute the charge provided by the corona wire. In this case, the corona wire can be biased to a relatively high value, such as approximately 5000–8000 volts, for example, while the corona grid is biased to a relatively low value, such as approximately 800–1000 volts, for example, to provide a desired surface charge on the surface of the photoreceptor drum. Increasing the corona and/or grid voltages will cause a corresponding increase in the voltage on the surface of the photoreceptor drum. In addition, the orientation and spacing of the corona wire and grid relative to the surface of the photoreceptor drum can affect the surface voltage on the drum. Thus, some adjustments in the physical location of the charging device can provide different charge levels on the surface of the drum, even with the same bias level for the corona wire and grid.

The charging device 18 may instead be a device that contacts the photoreceptor drum to provide the desired surface charge to the photoreceptor drum, such as a charging roller that extends generally along the width of the drum. If a contact device is used, however, a cleaning device may additionally be provided to prevent contamination of the charging roller caused by a transfer of toner or other materials from the photoreceptor drum.

The photoreceptor 12 may be part of a multi-pass processing system that is configured so at least one development unit or station is moved into and out of a processing position relative to the photoreceptor 12 as needed, where multiple development units containing different toner materials may be used to produce a multi-colored image. In such a multi-pass processing system, the photoreceptor 12 typically completes a processing cycle for each color or layer that is applied. Alternatively, the photoreceptor 12 may be a part of a tandem processing system that is configured so that at least one development unit or station is positioned adjacent to or in contact with the photoreceptor 12. In such a tandem electrophotographic process, multiple layers of different colored materials may be laid on top of one another in sequence with a single rapid pass of the photoreceptor 12 past multiple developer units or stations. It is understood, however, that any development units used within the processes of the present invention may include a wide variety of different configurations and equipment for transferring ink or transfer assist materials to a photoreceptor.

In accordance with the present invention, the electrophotographic apparatus 10 further includes a photoreceptor current measurement circuit 22 having a relatively small resistor 24 placed in the current return path 30 of the photoreceptor drum 12. A relatively inexpensive voltmeter 26 can be used to read the voltage across the resistor 24 when desired, for use in the adjustment calculations of the present invention. This measured voltage is then used in the basic relationship E=IR to calculate the current in the photoreceptor current measurement circuit 22, where E is the voltage across the resistor 24, I is the current through the resistor 24, and R is the resistance of the resistor 24. For one example, if the circuit is provided with a 10,000 ohm resistor and the voltage across the resistor is measured to be 10 volts, the current through the resistor can be determined to be 0.001 Amp, using the relationship E=IR (i.e., I=E/R, so 10/10,000=0.001). The drum current value may then be immediately provided to a printer central processing unit (CPU) 28 for subsequent use in determining whether the charging device setting should be changed. In particular, if the CPU determines that the photoreceptor surface voltage is within acceptable limits, no adjustments would need to be made to the charging device setting. However, if the CPU determines that the photoreceptor surface voltage has decreased by an amount that places that voltage out of an acceptable range, the charging device setting would need to be changed by a certain amount to bring the photoreceptor surface voltage back up to an acceptable value. As will be described in further detail below, the CPU will have certain tables of values relating the photoreceptor drum current to the photoreceptor surface voltage. These tables can be used so that any measurement of current provided to the CPU in real time can be compared to the table values to estimate the photoreceptor surface voltage. Any corrective action that needs to be taken to adjust this surface voltage can then be determined and implemented. Preferably, the measurements, testing, and corrections occur when the photoreceptor is not making prints, such as may be programmed to occur after certain time periods at certain times of the day (e.g., at midnight and noon of each day) or after a certain number of prints are produced.

The current measurement circuit 22 of the present invention may include any devices or systems for measuring current flow. The use of a resistor in a ground line with a voltmeter 26, as schematically illustrated in FIG. 1 is only one exemplary embodiment of the current measuring circuit 22. Alternatively, the current measuring circuit 22 may comprise a hall sensor, a true-current converter that utilizes an operational amplifier, or any other devices or systems that are preferably relatively small and inexpensive. An additional advantage that may be provided by the current measurement circuit is that the current measurement device can be a relatively small unit that can be placed in the electronics portion of the printer. In this way, the current measurement device can be protected from the relatively hostile environment of the inside of the printer (due to toners, heat, etc.). In addition, the inside of a printer is typically already relatively crowded with various devices and mechanisms for printing, therefore, it is preferable to not add other components, such as current measuring devices, to the inside of the printer itself.

As described above, increasing the voltage provided by the charging device can increase the surface voltage of a photoreceptor drum (that had a decreasing surface voltage) back to a level that can thereby extend the life of the photoreceptor drum. However, in accordance with the present invention, the expected behavior of an operating photoreceptor drum must be predicted in order to determine the exact adjustments and measurements that need to be made. Due to the precise conditions and close tolerances under which photoreceptor drums are typically manufactured, it is understood that measurement of the performance characteristics of at least one sample photoreceptor drum will provide a reasonably accurate prediction of the performance of other photoreceptor drums that are manufactured to the same specifications. In order to further verify that the performance characteristics are consistent between drums, measurements may be taken of multiple sample photoreceptor drums, if desired. This information may then be compiled to form the drum characteristics that will be described in detail below, either by averaging the results or by some other method.

Figure 2:
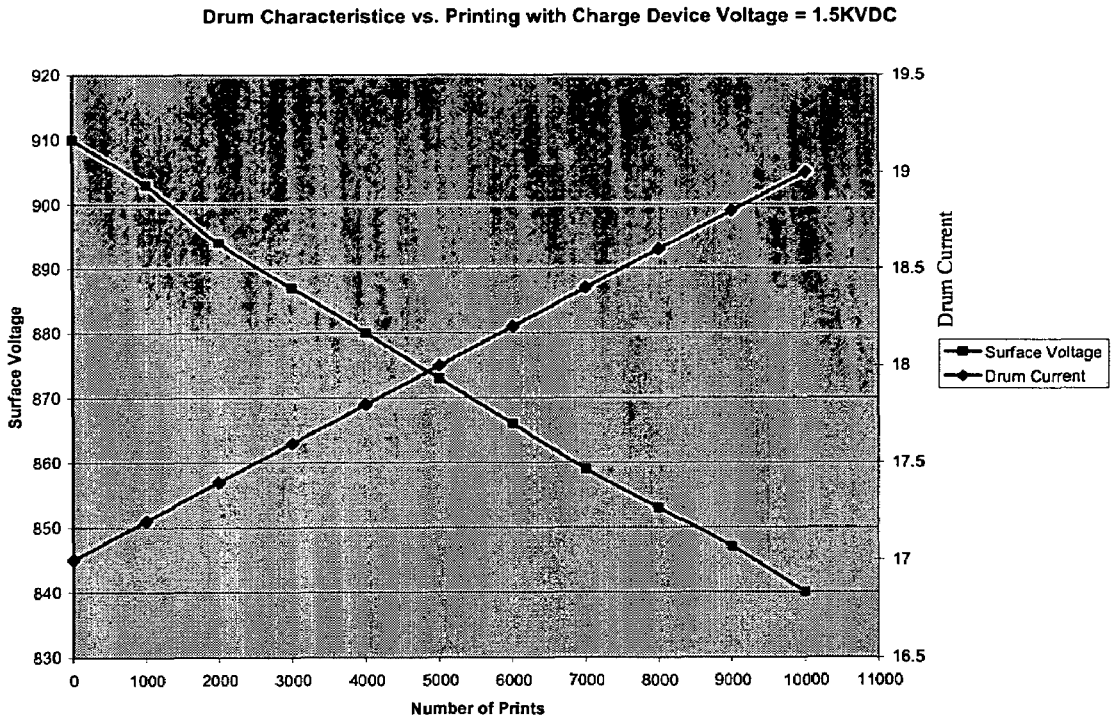
FIG. 2 is a graph illustrating an example of the surface voltage on a photoreceptor drum and the corresponding drum current for varying numbers of prints with a constant charge device voltage.

A charging device, such as device 18 of FIG. 1, preferably provides the charge on a photoreceptor drum surface. The charge value is typically set at a level that provides a certain desired surface voltage on the photoreceptor drum. FIG. 2 illustrates the performance of a sample photoreceptor drum that is subjected to a constant charge device voltage throughout a number of printing cycles. In this example, the charge device voltage provided was 1.5 KVDC, which was kept constant at this level for each of the testing increments. In particular, measurements of the surface voltage on the photoreceptor drum and the drum current were measured at 1,000 print intervals up to 10,000 prints. In particular, with a constant voltage being provided by the charging device, the surface voltage on the photoreceptor drum decreases as the number of prints processed by the drum increases. Conversely, the photoreceptor drum current increases as the number of prints processed by the drum increases. This figure thus illustrates the loss of surface charge on the photoreceptor drum as a function of use or age of the drum.

Initially, the photoreceptor drum surface may charge to a desired value at a particular setting of the charging device, but the photoreceptor drum surface may no longer charge to this desired value after multiple printing cycles have been completed. This change in performance can be at least partially due to chemical degradation of the surface layer or layers of the photoreceptor drum, which results in the photoreceptor drum becoming more conductive after multiple printing cycles. When this occurs, the drum is less able to receive and or hold a charge at a constant level. This lessening of surface charge over time eventually can cause an undesirable background stain to appear on the prints, which makes the photoreceptor drum no longer viable for producing high quality prints without some adjustment of the system.

The relationship between the change in the surface charge on the photoreceptor drum and the change in the photoreceptor drum current throughout the aging process of the drum is important in establishing the procedures of the present invention for increasing the useful life of a photoreceptor drum. This is accomplished by precisely changing the voltage provided by the charging device to compensate for the decrease in the photoreceptor drum surface voltage.

Figure 3:
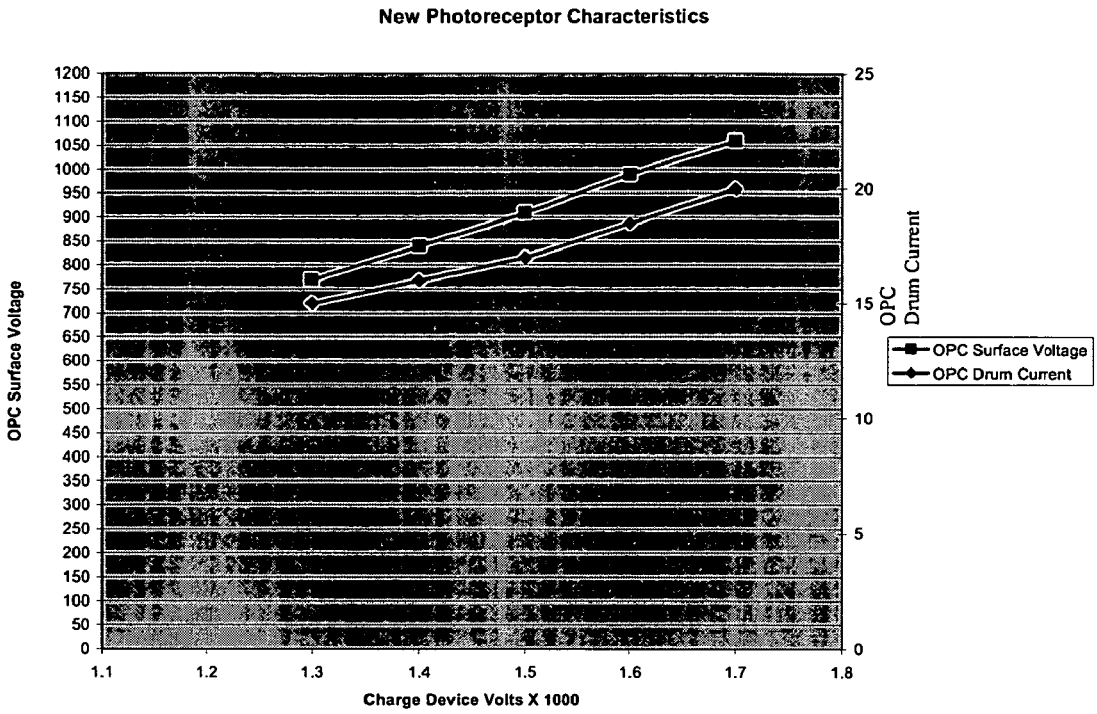
FIG. 3 is a graph illustrating an example of the surface voltage on a new photoreceptor drum and the corresponding drum current for different charge device voltages.

Another important performance characteristic of a photoreceptor drum is illustrated graphically in FIG. 3, which shows the performance of a new or unstressed photoreceptor drum when subjected to different charge levels from a charging device. In particular, as the voltage provided by the charging device to the surface of the photoreceptor drum is changed, both the surface charge on the photoreceptor drum and the photoreceptor drum current are measured with the photoreceptor drum in its new or unstressed condition. Measurements of the surface voltage of the photoreceptor drum and the drum current were taken at increasing voltage increments of the charging device from 1.3KV to 1.7KV. As shown, an increase in the voltage provided by the charging device increases the surface voltage on the photoreceptor drum. As with the other performance characteristics discussed relative to the photoreceptor drum, the increase in surface voltage is generally linear. In addition, the photoreceptor drum current is preferably measured at the same intervals of increasing charging device voltage at which the photoreceptor drum surface charge levels are measured. It is possible, however, that the drum current be measured at different charging device intervals. In either case, the results should provide a line having the same slope for the drum current, with the photoreceptor drum current increasing as the surface voltage increases.

While the measurements of a new photoreceptor drum before it is in operation are relatively easy to acquire, once a photoreceptor drum is in operation in a printer, the relatively high cost and large size of electrostatic voltage measurement devices make it difficult to measure photoreceptor drum surface voltage throughout the life of the drum. Thus, in order to determine the predicted behavior of a photoreceptor drum to different charging device voltages, it is further necessary to measure the performance of a photoreceptor drum in a stressed condition. A photoreceptor drum may be considered to be at least slightly stressed after only a few printing cycles; however, a stressed photoreceptor drum will typically have completed many thousands of printing cycles, perhaps in excess of 10,000 or 20,000. In accordance with the invention, it is preferable that the surface voltage and current of a photoreceptor drum in its stressed condition are measured at a point that is close to its anticipated useful life in order to determine the effect of the repetitive charging cycles on the photoreceptor drum performance. The results of taking these measurements on the photoreceptor drum in a stressed condition (e.g., after 10,000 prints have been run using that photoreceptor drum) are shown graphically in FIG. 4. Preferably, the photoreceptor drum measured to obtain the type of results shown in FIG. 4 is the same photoreceptor drum measured to obtain the results of FIGS. 2 and 3.

Figure 4:
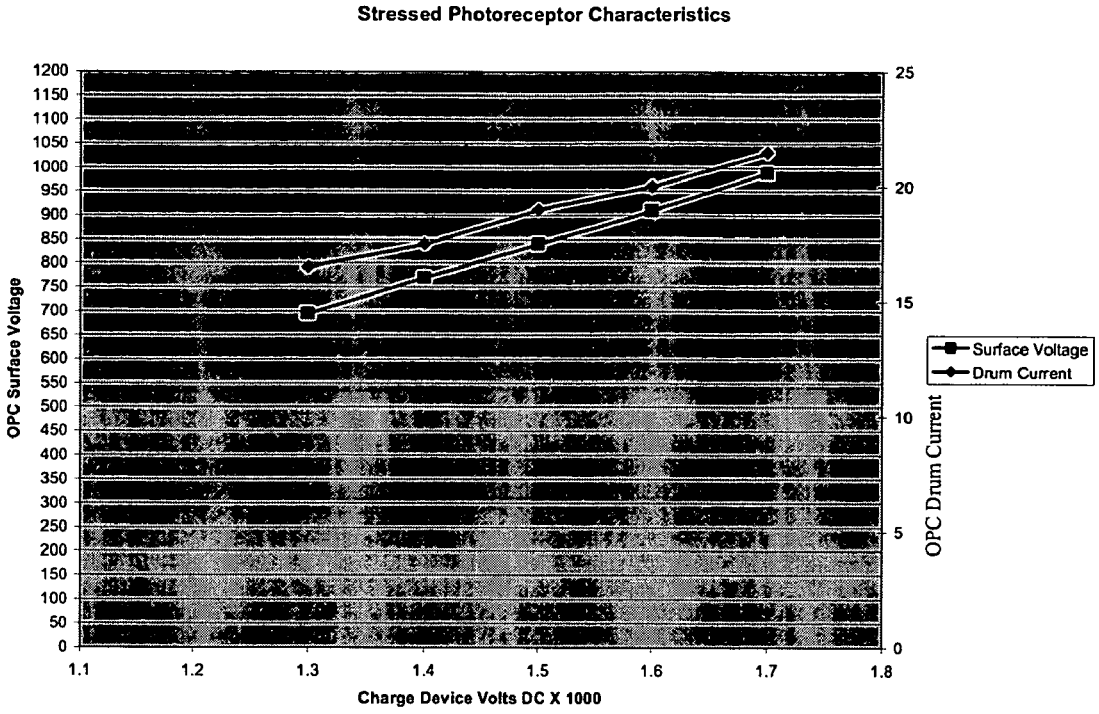
FIG. 4 is a graph illustrating an example of the surface voltage and corresponding drum current for a stressed photoreceptor drum that has run through multiple printing cycles when subjected to different charge device voltages.

FIG. 4 graphically shows the trend in the surface voltage and drum current of a photoreceptor drum in its stressed condition. In this particular case, as the voltage provided by the charging device increases, both the photoreceptor drum current and the surface voltage on the photoreceptor drum increase generally linearly. Notably, the stressed drum draws more current at the same surface voltage than the amount of current a new or unstressed drum draws. This is true because, as discussed previously relative to FIG. 2, the drum current increases as a drum is more stressed, while the surface charge of the drum decreases as it becomes more stressed.

The information obtained and recorded in FIG. 3 (the behavior of a new drum) and FIG. 4 (the behavior of a stressed drum) are then used to construct a mathematical relationship for correction voltages at any point in the life of a particular photoreceptor drum, where the life of a photoreceptor drum may be expressed in the number of prints made, for example. In particular, the results of FIGS. 3 and 4 are used to write an equation for a straight line in the surface voltage domain that passes through the data points for both the new drum and the stressed drum. These equations can then be used to provide results that are shown graphically in FIG. 5. This figure graphically illustrates a family of five correction curves that were calculated for the same photoreceptor drum as discussed above relative to FIGS. 2 through 4. Each of these correction curves corresponds to a different applied voltage provided by the charging device. These correction curves are determined by plotting the photoreceptor surface voltage at a certain number of print cycles for various voltages applied by the charging device, then extrapolating to determine the surface voltage for print cycle quantities outside of this range. For example, the surface voltage can be measured for a new photoreceptor drum subjected to a certain voltage from the charging device, then the same measurement can be made for a photoreceptor drum that has run through 10,000 cycles when subjected to this same voltage from the charging device. These two points can be plotted and a straight line drawn between them to determine the predicted performance of a photoreceptor drum that has completed more or less than 10,000 print cycles.

To further illustrate how the graphs of FIGS. 3 and 4 can be used to predict the performance of a photoreceptor drum, one example of the performance of a certain drum having a voltage applied thereto of 1.3 kV provided by a charging device is described. Referring to FIG. 3, when the charging device provided 1.3 kV, the photoreceptor drum has a surface voltage of 770 volts when the drum is unstressed. As shown in FIG. 4, the same photoreceptor drum has a surface voltage of 695 volts when the drum has completed 10,000 print cycles. These two points are then plotted graphically and a straight line drawn between them, as shown graphically in FIG. 5.

Figure 5:
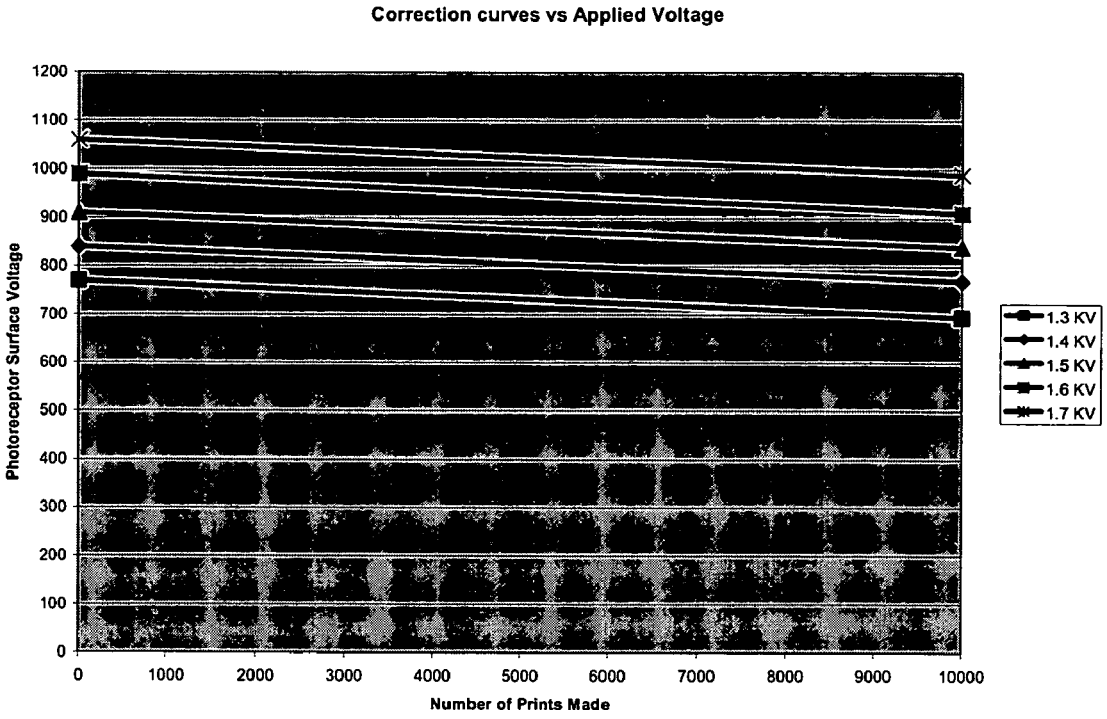
FIG. 5 is a graph illustrating an example of a family of correction curves that are used in accordance with the results of FIGS. 2 though 4 to obtain the charge device adjustments necessary to improve the performance of a particular photoreceptor drum.

The correction curves of FIG. 5 are preferably programmed into the CPU of the printer for use in determining the voltage that should be applied by the charging device to maintain a certain photoreceptor drum surface voltage as the drum ages. The information provided by FIG. 2 is likewise programmed into the CPU.

The information obtained above can be used to extend the life of a photoreceptor drum by following the general procedures described below (with specific values used only for illustration purposes), where variations in the different steps are considered to be within the scope of the invention. Further, it is preferable that the CPU is programmed to accept certain input values for use in calculating the data points used in accordance with the methods of the invention. First, a reference voltage applied by the charging device is chosen to establish the desired surface charge of the photoreceptor drum. For example, a charging device set at 1.5 kV will provide a charge-up surface voltage on the photoreceptor drum of approximately 910 volts (see FIG. 2 or 3). A certain number of prints should then be run, such as several hundred or several thousand prints. The printing process is then stopped so that the reference voltage can again be applied and the current measured through the photoreceptor current return path, such as is illustrated as circuit 22 in FIG. 1. In the present example, the current is measured to be approximately 17.8 microamps. Referring to FIG. 2, this current measurement corresponds to a photoreceptor drum that has gone through approximately 4000 print cycles.

The family of correction curves in FIG. 5 is then analyzed to interpolate the charge device applied voltage to obtain the same desired surface charge on the photoreceptor drum. In this example, to obtain a surface charge on the photoreceptor drum of 910 volts, the correction curves of FIG. 5 indicate that 1.53 KV of applied voltage must be provided by the charging device to obtain this surface voltage. The charging device voltage is then preferably adjusted to again obtain the desired surface voltage on the photoreceptor drum, which is 1.53 KV in this example. With this increased voltage on the charging device, the performance of the photoreceptor drum should be the same as the performance of a new drum, since the surface charge voltage is now the same as when the drum was new.

Another group of prints should then be run, such as another several hundred or several thousand prints. The printing process is then stopped so that the reference voltage can again be applied and the current measured through the photoreceptor current return path, such as is illustrated as in circuit 22 of FIG. 1. In the present example, the photoreceptor current is measured to be approximately 19.0 microamps with an applied reference voltage of 1.5 KV. Referring to FIG. 2, this current measurement corresponds to a photoreceptor drum that has gone through approximately 10,000 print cycles. The family of correction curves in FIG. 5 is again used to interpolate the charge device applied voltage to obtain the same desired surface voltage on the photoreceptor drum. In this example, to obtain a surface voltage on the photoreceptor drum of 910 volts, the correction curves of FIG. 5 indicate that 1.6 KV of applied voltage must now be provided by the charging device to obtain this surface voltage. The charging device voltage is then preferably adjusted to 1.6 KV to again obtain the desired surface voltage on the photoreceptor drum, which is 910 volts in this example. Printing may again continue, with the performance of the photoreceptor drum being similar to that of a new drum since the surface voltage should be the same as when the drum was new; the only difference in the process is that the voltage provided by the charging device is larger than the voltage it provided when the drum was new.

This sampling and adjustment sequence can continue as many times as desired until a predetermined maximum voltage for the charging device is reached. This maximum voltage may be either a limit of the charging device, or may be a function of the ability of the photoreceptor drum to accept and maintain a certain surface charge after a large number of cycles have been run (e.g., the photoreceptor drum surface quality has degraded and/or become unstable). At this point, the photoreceptor drum will be considered to have exhausted its useful life and will need to be replaced.

As discussed above, it is preferable that the measurements of the current in the photoreceptor current return path are taken when the printer is not printing so that no developing or transferring of prints is occurring. This is important because the currents necessary for accepting toner onto the photoreceptor drum or transferring toner from the photoreceptor drum will add to or subtract from the total current that is being measured to obtain the actual surface voltage of the photoreceptor drum.

Another embodiment of the present invention includes reference to a print counter to better resolve any potential inaccuracies in the measurements or calculations. This can be accomplished by associating the print number with the voltage/current/charge device setting data in the tables and information stored in the CPU.

Another embodiment of the invention includes reference to a table of ambient temperature values that can be used if the photoreceptor charging process is sensitive to temperature. The printer would then desirably include a device for sensing temperature that could provide input to the CPU for comparison and analysis with the other data in the CPU.

Similarly, another embodiment of the invention includes reference to a table of relative humidity values that can be used if the photoreceptor charging process is sensitive to humidity. The printer would then desirably include an relative humidity sensor that could provide input to the CPU for comparison and analysis with the other data in the CPU.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A method of maintaining a surface voltage on a photoreceptor within a predetermined operational voltage range, the method comprising the steps of:

providing a charging device adjacent to an outer surface of the photoreceptor;

determining a reference voltage to be applied by the charging device to the photoreceptor outer surface to establish a first photoreceptor surface voltage that is within the predetermined operational voltage range;

applying the reference voltage to the outer surface of the moving photoreceptor with the charging device while measuring a first photoreceptor current;

comparing the first photoreceptor current to predetermined characteristics of the photoreceptor to calculate a first output value;

comparing the first output value to predetermined characteristics of the photoreceptor and calculating a first correction voltage to be applied by the charging device; and applying the first correction voltage to the photoreceptor outer surface with the charging device to obtain a surface voltage on the photoreceptor that is within the predetermined operational voltage range.

2. The method of claim 1, wherein the first correction voltage is higher than the reference voltage.

3. The method of claim 1, wherein the first correction voltage is the same as the reference voltage.

4. The method of claim 1, further comprising the following steps after the step of applying the first correction voltage to the photoreceptor:

charging the photoreceptor for a plurality of printing cycles with the first correction voltage provided by the charging device;

applying the reference voltage to the outer surface of the photoreceptor with the charging device while measuring a second photoreceptor current;

comparing the second photoreceptor current to predetermined characteristics of the photoreceptor to calculate a second output value;

comparing the second output value to predetermined characteristics of the photoreceptor and calculating a second correction voltage to be applied by the charging device; and applying the second correction voltage to the photoreceptor outer surface with the charging device to obtain a surface voltage on the photoreceptor that is within the predetermined operational voltage range.

5. The method of claim 1, wherein the charging device is a corona.

6. The method of claim 1, wherein the step of applying the reference voltage to the photoreceptor while measuring the first photoreceptor current comprises measuring the current through a current measuring circuit of the photoreceptor.

7. The method of claim 6, wherein the current measuring circuit includes a resistive element.

8. The method of claim 1, wherein the first correction voltage is applied to the photoreceptor outer surface with the charging device through a specific number of processing cycles of the photoreceptor while the surface voltage on the photoreceptor is within the predetermined operational voltage range, further comprising the step of stopping the processing cycles of the photoreceptor after the specific number of cycles are completed.

9. The method of claim 1, wherein the steps of applying the reference voltage and applying the first correction voltage are performed between printing cycles of the photoreceptor.

10. The method of claim 1, wherein the first output value is a quantity of prints processed by the photoreceptor.

11. The method of claim 1, wherein the first output value is a photoreceptor surface voltage.

12. The method of claim 1, wherein the predetermined characteristics of the photoreceptor are calculated using data collected from tests conducted on a sample photoreceptor prior to the application of a reference voltage to the photoreceptor.

13. The method of claim 12, wherein the sample photoreceptor is substantially functionally similar to the photoreceptor to which the reference voltage and first correction voltage are being applied so that performance characteristics of the sample photoreceptor can be used to predict the performance characteristics of the photoreceptor to which the reference voltage and first correction voltage are applied.

14. The method of claim 12, wherein one of the predetermined characteristics of the photoreceptor comprises a family of correction curves calculated using the data collected from tests conducted on the sample photoreceptor, and wherein the family of correction curves are used to obtain the first correction voltage applied by the charging device.

15. The method of claim 12, wherein the calculated predetermined characteristics of the photoreceptor are stored in a central processing unit.

16. The method of claim 1, wherein one of the predetermined characteristics of the photoreceptor comprises a relationship between the photoreceptor surface voltage and the photoreceptor current for a sample photoreceptor subjected to a constant charging device voltage through varying numbers of processing cycles.

17. The method of claim 1, wherein one of the predetermined characteristics of the photoreceptor comprises a relationship between the photoreceptor surface voltage and the photoreceptor current for a sample photoreceptor when subjected to increasing voltages applied by the charging device.

18. The method of claim 1, wherein one of the predetermined characteristics of the photoreceptor comprises a relationship between the photoreceptor surface voltage and the photoreceptor current for a photoreceptor that has completed multiple processing cycles when subjected to increasing voltages applied by the charging device.

19. The method of claim 1, wherein one of the predetermined characteristics of the photoreceptor is a relationship between a quantity of processing cycles completed by the photoreceptor and the photoreceptor surface voltage.

20. A method of adjusting the voltage provided by a charging device to maintain a surface voltage on a photoreceptor within a predetermined operational voltage range, wherein a charging device is provided adjacent to an outer surface of the photoreceptor, wherein a reference voltage is determined and applied by the charging device to the photoreceptor outer surface to establish a first photoreceptor surface voltage that is within the predetermined operational voltage range, wherein the reference voltage is applied to the outer surface of the moving photoreceptor with the charging device while measuring a first photoreceptor current, wherein the first photoreceptor current is compared to predetermined characteristics of the photoreceptor to calculate a first output value, wherein the first output value is compared to predetermined characteristics of the photoreceptor, wherein a calibration correction voltage to be applied by the charging device is calculated, wherein the calibration correction voltage is applied to the photoreceptor outer surface with the charging device to obtain a surface voltage on the photoreceptor that is within the predetermined operational voltage range, and wherein the photoreceptor is charged for a plurality of printing cycles with the calibration correction voltage provided by the charging device, the method comprising sequentially repeating the following steps (a) through (e) until a predetermined maximum voltage level of the charging device is reached;

(a) applying the reference voltage to the outer surface of the photoreceptor with the charging device while measuring an operating photoreceptor current;

(b) comparing the operating photoreceptor current to predetermined characteristics of the photoreceptor to calculate an adjusted output value;

(c) comparing the adjusted output value to predetermined characteristics of the photoreceptor and calculating an adjusted correction voltage to be applied by the charging device;

(d) applying the adjusted correction voltage to the photoreceptor outer surface with the charging device to obtain a surface voltage on the photoreceptor that is within the predetermined operational voltage range; and (e) charging the photoreceptor for a plurality of printing cycles with the adjusted correction voltage applied by the charging device.

21. The method of claim 20, wherein the adjusted correction voltage is greater than the calibration correction voltage.

22. The method of claim 20, wherein the adjusted correction voltage is the same as the calibration correction voltage.

23. The method of claim 20, wherein the step of applying the reference voltage to the outer surface of the photoreceptor with the charging device while measuring an operating photoreceptor current comprises measuring the current through a current measuring circuit of the photoreceptor.

24. The method of claim 23, wherein the current measuring circuit comprises a resistive element.

25. A method of initializing a photoreceptor for use in a system for adjusting the voltage provided by a charging device to maintain a surface voltage on a photoreceptor within a predetermined operational voltage range, the method comprising the steps of:

providing a charging device adjacent to an outer surface of the photoreceptor;

determining a reference voltage to be applied by the charging device to the photoreceptor outer surface to establish a first photoreceptor surface voltage that is within the predetermined operational voltage range;

applying a reference voltage to the outer surface of the moving photoreceptor with the charging device while measuring a first photoreceptor current;

comparing the first photoreceptor current to predetermined characteristics of the photoreceptor and calculating a first output value;

comparing the first output value to predetermined characteristics of the photoreceptor and calculating a calibration correction voltage to be applied by the charging device;

applying the calibration correction voltage to the photoreceptor outer surface with the charging device to obtain a surface voltage on the photoreceptor that is within the predetermined operational voltage range; and charging the photoreceptor for a plurality of printing cycles with the calibration correction voltage provided by the charging device.

* * * * *